US006474365B1

(12) United States Patent
Brown et al.

(10) Patent No.: US 6,474,365 B1
(45) Date of Patent: Nov. 5, 2002

(54) OVERFLOW DRAIN OUTLET COVER SYSTEM

(76) Inventors: Kenneth E. Brown, 1700 W. Gila La., Chandler, AZ (US) 85224; Cindy K. Brown, 1700 W. Gila La., Chandler, AZ (US) 85224

( * ) Notice: Subject to any disclaimer, the term of this patent is extended or adjusted under 35 U.S.C. 154(b) by 0 days.

(21) Appl. No.: 09/839,019

(22) Filed: Apr. 21, 2001

(51) Int. Cl.[7] ..... F16K 15/03

(52) U.S. Cl. ..... 138/96 R; 137/527.6; 137/360; 4/211

(58) Field of Search ..... 138/96 R; 137/527.8, 137/527.6, 360; 4/211

(56) References Cited

U.S. PATENT DOCUMENTS 1,063,637 A * 6/1913 Barker ..... 137/527.6
2,024,339 A * 12/1935 Connell ..... 137/527.6
2,259,128 A * 10/1941 Egan ..... 137/527.6
2,463,662 A * 3/1949 Wallace ..... 137/527.6
2,947,321 A * 8/1960 Kovalcik ..... 137/516.25
4,498,876 A * 2/1985 Zemlicka ..... 137/527.8
4,512,366 A * 4/1985 Lewis ..... 137/527.8
4,850,059 A * 7/1989 Dickerson ..... 4/211
4,917,147 A * 4/1990 Jerkins ..... 137/584
4,967,790 A * 11/1990 Ganske ..... 137/514.5
5,031,659 A * 7/1991 Gonzales et al. ..... 137/360
5,044,396 A * 9/1991 Daudet et al. ..... 137/515.5
6,109,297 A * 8/2000 Shackelford ..... 137/527.6
6,200,672 B1 * 3/2001 Tadokoro et al. ..... 428/328

* cited by examiner

*Primary Examiner*—Patrick Brinson
(74) *Attorney, Agent, or Firm*—Martin L. Stoneman

(57) ABSTRACT

A system for covering drain pipe outlets, particularly, as they exit a building. The system includes a band that is tightened around the exterior of a pipe as it protrudes through the side of a building. Attached to the band is a hinged cover which is sized to entirely cover the pipe and hidden hinge. The cover may be covered with material to match or complement the building exterior surfacing, such as paint or stucco. In addition, the band portion may also include one or more restictors, such as bars, to prevent unauthorized access or debris from entering the pipe. The system provides for multiple size covers and bands for a wide variety of pipe sizes.

22 Claims, 2 Drawing Sheets

OVERFLOW DRAIN OUTLET COVER SYSTEM

BACKGROUND

This invention relates to providing a system for covering a wall drain outlet pipe, extending from the exterior wall of a building, while allowing water flow from the pipe. In addition, the system provides for a cover having a surface which is bondable to a coating in order to provide a more aesthetically pleasing building exterior.

Typically, drain pipe outlets are used to allow water to be drained either from a building rooftop, or a system within the building, such as a fire sprinkler system or an air conditioning system. Typically, drain pipe outlets range in size from about 2 inches in diameter up to about 24 inches in diameter. They typically exit the side of a building structure through a wall, thereby allowing the water to flow towards a designated drainage area. The great majority of these drain pipe outlets are roof drain outlets. Roof drain outlets typically extend from the roof down through the inside of the building to a point roughly twelve inches above ground, where they exit to the building exterior. These roof drain outlet openings are typically left uncovered such that the pipe outlet opening is parallel with the face of the building exterior. The pipe outlet openings are unsightly and detract from the building appearance. Debris, vermin and even children may enter these uncovered pipe outlets, potentially blocking them or providing an unsafe or unsanitary condition.

OBJECTS OF THE INVENTION

A primary object and feature of the present invention is to provide a system for covering drain pipe outlets while not deterring from their function.

It is a further object and feature of the present invention to provide such a system which allows the drain pipe outlet cover to be painted or coated with a material and/or color that blends in with the building exterior.

It is another object and feature of the present invention to provide such a system which provides a restrictor to restrict access to the pipe outlets from debris and vermin.

It is yet another object and feature of the present invention to provide such a system which provides a variety of sizes to fit different pipe diameters.

It is still another object and feature of the present invention to provide such a system which provides a simple installation.

A further primary object and feature of the present invention is to provide such a system which is efficient, inexpensive, and handy. Other objects and features of this invention will become apparent with reference to the following descriptions.

SUMMARY OF THE INVENTION

According to a preferred embodiment of the present invention, there is provided a pipe cover system for a pipe end opening of a wall drain outlet pipe, comprising, in combination: a cover structured and arranged to substantially cover the wall drain outlet pipe end opening; an attacher structured and arranged to attach such cover to the pipe end opening; and a cover opening system structured and arranged to allow flowing water to open such cover sufficiently to allow flowing water to pass from the pipe end opening. It also provides such a system further comprising a restrictor structured and arranged to assist in restricting unwanted matter from entering the pipe end opening. And, it provides such a system wherein such cover opening system comprises at least one rotator structured and arranged to rotatedly open such cover sufficiently to allow flowing water to pass from the pipe end opening. Further, it provides such a system wherein such rotator comprises at least one hinge structured and arranged to hingedly connect such cover to such attacher.

Additionally, it provides such a system wherein at least one surface of such cover is structured and arranged to be bondable to a coating; and, wherein such at least one surface of such cover is structured and arranged to be bondable to a cementitious coating. Also, it provides such a system wherein such at least one surface of such cover is structured and arranged to be bondable to a paint coating. Further, it provides such a system wherein such cover and such at least one hinge are structured and arranged such that such at least one hinge supports such cover at a cover top portion and allows rotation of such cover outwardly in such manner that when flowing water gravitates from such pipe to such cover, such cover swings open sufficiently to allow flowing water to pass from the pipe end opening. Even further, it provides such a system wherein at least one surface of such cover is structured and arranged to be bondable to a coating. Still further, it provides such a system wherein such attacher further comprises a clamp structured and arranged to substantially engage a circumference of the pipe end opening and be tightened around the pipe end opening.

Moreover, it provides such a system wherein such attacher further comprises a clamp structured and arranged to substantially engage a circumference of the pipe end opening and be tightened around the pipe end opening. And, it provides such a system wherein such attacher further comprises a clamp structured and arranged to substantially engage a circumference of the pipe end opening and be tightened around the pipe end opening. It also provides such a system wherein such attacher comprises such rotator. Even further, it provides such a system further comprising: a wall drain outlet pipe having a pipe end opening; wherein such cover is attached to such pipe end opening by such attacher. Still further, it provides such a system further comprising: a building substantially enclosing such wall drain outlet pipe; wherein such pipe end opening is situated at an exterior wall location of such building.

According to another preferred embodiment of the present invention, there is provided a pipe cover system for a pipe end opening of a wall drain outlet pipe, comprising, in combination: a cover structured and arranged to cover the pipe end opening, wherein a surface of such cover is structured and arranged to be bondable to a coating; and at least one hinge structured and arranged so that such at least one hinge, when attached with the pipe end opening, supports such cover at a cover top portion and allows rotation of such cover outwardly in such manner that when flowing water gravitates from the wall drain outlet pipe to such cover, such cover swings open sufficiently to allow flowing water to pass from the pipe end opening. It also provides such a system further comprising a circular band with an adjustable tightener, such band being structured and arranged to be tightened around an external surface of the wall drain outlet pipe adjacent the pipe end opening.

Additionally, it provides such a system wherein such hinge connects such cover with such circular band. And, it provides such a system further comprising a restrictor attached to such circular band, such restrictor being structured and arranged to assist in restricting unwanted matter from entering the pipe end opening. It also provides such a system wherein: such restrictor comprises at least one round bar; and wherein such cover has a diameter about two inches greater than a diameter of the pipe.

DETAILED DESCRIPTION OF A PREFERRED EMBODIMENT OF THE INVENTION

Figure 1:
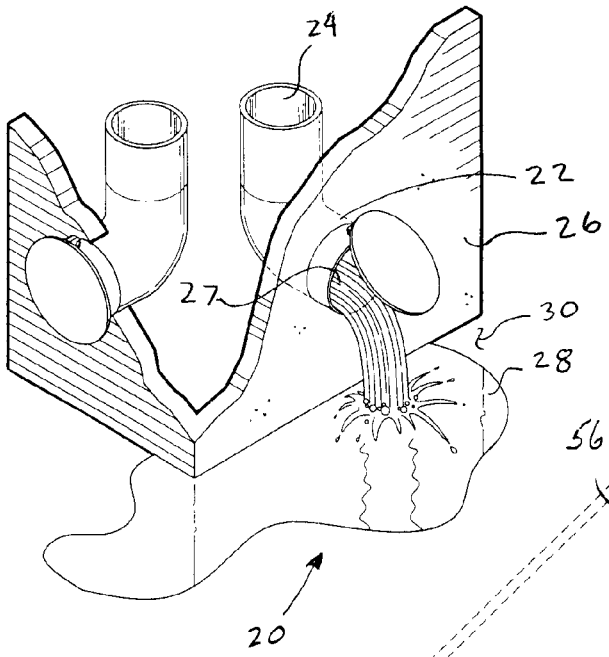
FIG. 1 is a perspective view of the overflow drain outlet cover system illustrated in a typical use on the side of a building, according to a preferred embodiment of the present invention.

FIG. 1 is a perspective view of the overflow drain outlet cover system 20 illustrated in a typical use, installed on a pipe 22, extending from the down-spout 24 of preferably, a roof drain, installed along the inside portion of a building (embodying herein a building substantially enclosing such wall drain outlet pipe) and extending through the exterior side of a building 26 (embodying herein wherein such pipe end opening is situated at an exterior wall location of such building), according to a preferred embodiment of the present invention. Preferably, the pipe 22 extends such that the pipe and pipe opening 27 (embodying herein a wall drain outlet pipe having a pipe end opening) are at least two inches beyond the building 26. The down-spout 24 may also extend from a fire sprinkler system or other system where water 28 is to be released to the building exterior 30.

Figure 2:
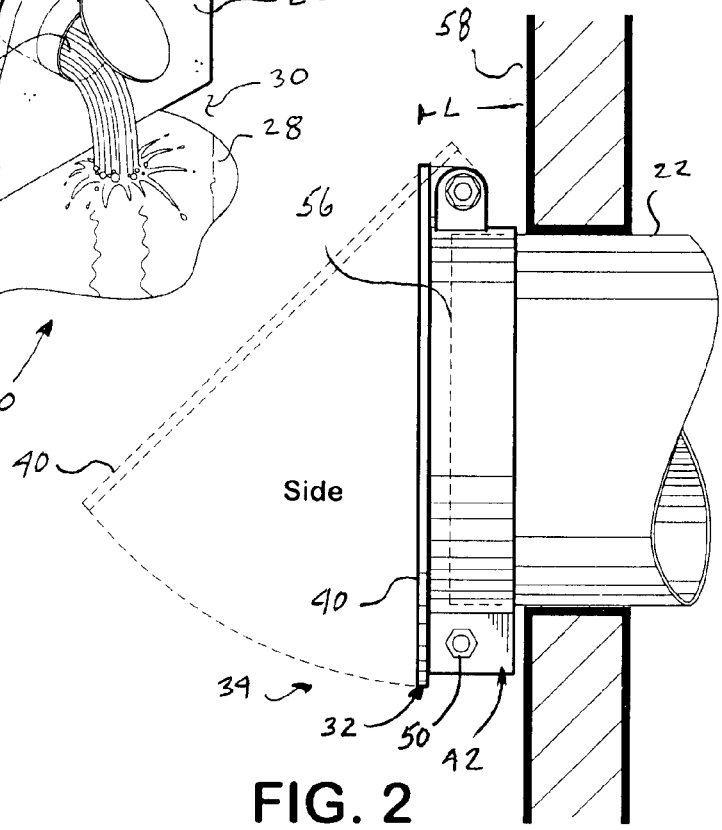
FIG. 2 is a side view, partially in section, of the overflow drain outlet cover system, according to a preferred embodiment of the present invention.
Figure 3:
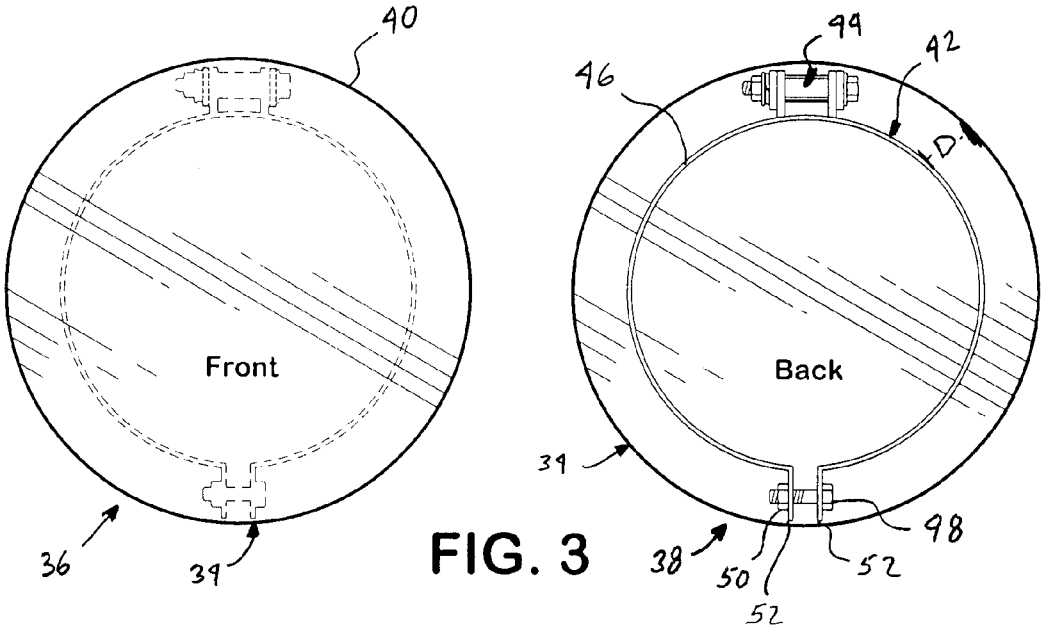
FIG. 3 is a front and back view of the overflow drain outlet cover system, according to a preferred embodiment of the present invention.

FIG. 2 is a side view, partially in section, of an overflow drain outlet cover 32, according to a preferred embodiment 34 of the present invention. FIG. 3 is a front view 36 and back view 38 of the overflow drain outlet cover 32, according to embodiment 34 of the present invention. In reference to the above figures, preferably, the overflow drain outlet cover 32 comprises a cover 40 (embodying herein a cover structured and arranged to substantially cover the wall drain outlet pipe end opening) attached to an attachment band 42 (embodying herein an attacher structured and arranged to attach such cover to the pipe end opening) by means of a simple hinge 44 arrangement (embodying herein wherein such cover opening system comprises at least one rotator structured and arranged to rotatedly open such cover sufficiently to allow flowing water to pass from the pipe end opening; and, also embodying herein wherein such rotator comprises at least one hinge structured and arranged to hingedly connect such cover to such attacher; and, also embodying herein wherein such attacher comprises such rotator). Preferably, hinge 44 is mounted to cover 40 such that cover 40 hangs in about a vertical position, as shown. Preferably, the hinge arrangement is such that water 28 will flow freely from pipe 22 passing cover 40 (this arrangement embodying herein a cover opening system structured and arranged to allow flowing water to open such cover sufficiently to allow flowing water to pass from the pipe end opening). Preferably, a minimum amount of water pressure may push the cover 40 open, allowing the water 28 to flow out of the pipe 22. Preferably, the attachment band 42 consists of a circular shaped band 46 with closure tabs 52 at each end (shown more clearly in FIG. 6), having two aligned apertures 54 such that a closure adjusting bolt 48 and nut 50 will fit through the two aligned apertures 54. Preferably, circular band 46 is manufactured in multiple sizes such that it is slightly larger than the pipe diameter to which it is intended to be slip-fit over, and, as such, the circular band 46 may be tightened around the pipe 22 by tightening the closure adjusting bolt 48 and nut 50, in well-known ways (this arrangement embodying herein wherein such attacher further comprises a clamp structured and arranged to substantially engage a circumference of the pipe end opening and be tightened around the pipe end opening). Preferably, the circular band 46 requires a minimum length L of extended pipe 56 from the building face 58 to connect onto. The preferred minimum length L of extended pipe 56 is about two inches. Additionally, in order to hide the hinge 44, the cover 40 preferably extends a minimum distance D from the attachment band 42 to the edge of the cover 40. Preferably, distance D is no more than about two inches (embodying herein wherein such cover has a diameter about two inches greater than a diameter of the pipe).

In order to provide a finish on cover 40 that will preferably match the finish of the exterior side of the building 26, cover 40 is preferably made from paint-coat-treated galvanized steel. Preferably, paint-coat-treated galvanized steel will accept paint, exterior finish systems and cementitious materials, such as that commonly referred to as stucco (embodying herein wherein at least one surface of such cover is structured and arranged to be bondable to a coating; and, wherein such at least one surface of such cover is structured and arranged to be bondable to a cementitious coating; and also, wherein such at least one surface of such cover is structured and arranged to be bondable to a paint coating). Under appropriate circumstances, other cover materials with respect to coatable materials may be useful. Preferably, cover 40 may be covered with a matching exterior finish to that of the building.

Figure 4:
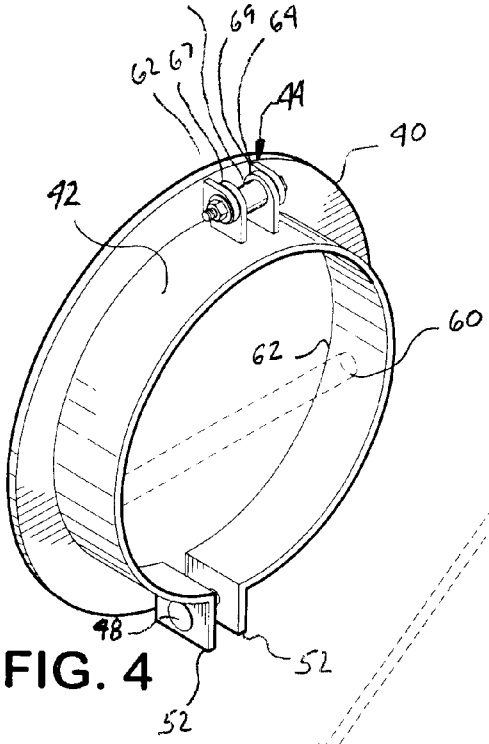
FIG. 4 is a perspective view of the overflow drain outlet cover system illustrating a restrictor, according to a preferred embodiment of the present invention.

FIG. 4 is a perspective view of the overflow drain outlet cover system 20 illustrating a restrictor 60 (embodying herein a restrictor structured and arranged to assist in restricting unwanted matter from entering the pipe end opening), according to a preferred embodiment of the present invention. In this embodiment, the restrictor 60 is shown installed horizontally in the attachment band 42. The restrictor 60 may be one or more preferably, round bars, as shown, which are placed towards the front 62 of opening 64 such that the attachment band 42 is still functionally able to attach to the pipe 22 (this arrangement embodying herein wherein such restrictor comprises at least one round bar; and, a restrictor attached to such circular band, such restrictor being structured and arranged to assist in restricting unwanted matter from entering the pipe end opening). Preferably, the round bars are between one-half and three-quarters inches in diameter, providing at least one, to one and one-half inches of attachment on the attachment band 42 to encircle pipe 22. Preferably, the restrictor 60 may be placed in any combination of, for example, horizontal and vertical bars, so long as the restrictor 60 does not block water flow from the pipe. The pipe 22 and cover 40 may come in a variety of sizes. Preferably, the pipe diameters and associated attachment band 42 sizes typically range from about two inches, to about 24 inches in diameter. In order to accommodate various local building codes and other such authority, the overflow drain outlet cover system 20 may be adapted such that the restrictor 60 adequately restricts access to the pipe by, for example, children.

Figure 5:
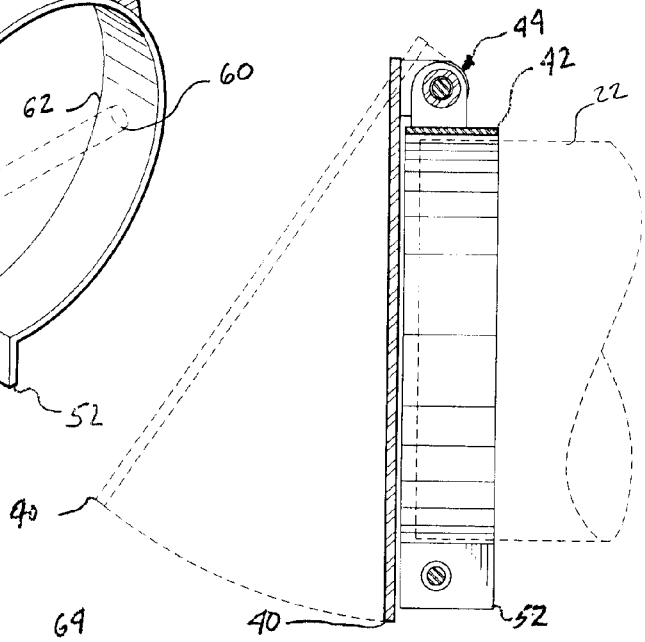
FIG. 5 is a side view, partially in section, of the overflow drain outlet cover system illustrating the cover movement, according to a preferred embodiment of the present invention.

FIG. 5 is a side view, partially in section, of the overflow drain outlet cover system 20 illustrating the cover 40 movement, according to a preferred embodiment of the present invention. Preferably, as illustrated in FIG. 5, cover 40 swivels upward and outward as it opens (embodying herein wherein such cover and such at least one hinge are structured and arranged such that such at least one hinge supports such cover at a cover top portion and allows rotation of such cover outwardly in such manner that when flowing water gravitates from such pipe to such cover, such cover swings open sufficiently to allow flowing water to pass from the pipe end opening).

Figure 6:
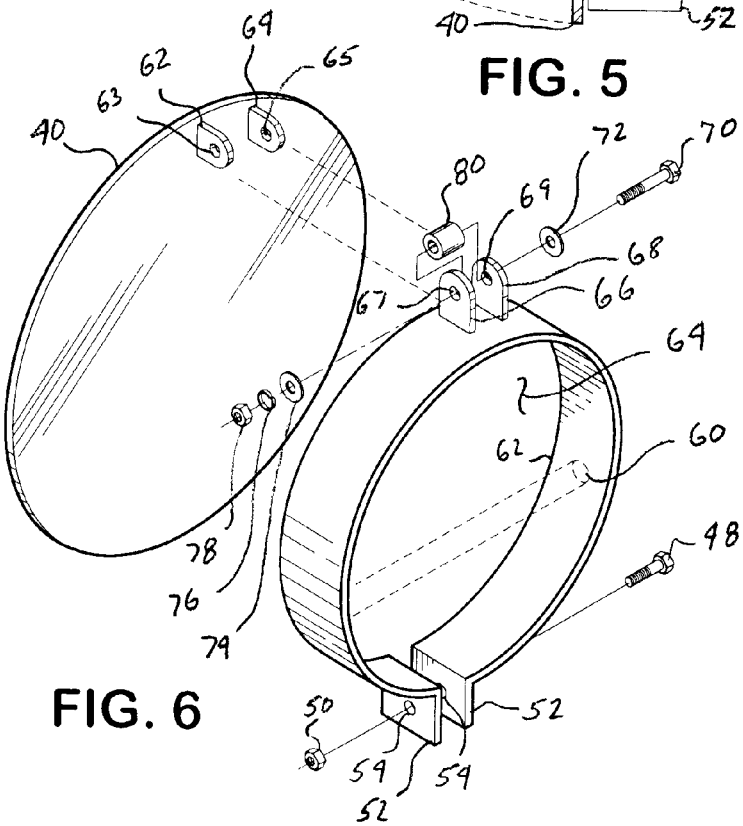
FIG. 6 is an exploded perspective view of the overflow drain outlet cover system, according to a preferred embodiment of the present invention.

FIG. 6 is an exploded perspective view of the overflow drain outlet cover system 20, according to a preferred embodiment of the present invention. These figures further illustrate the parts and connections of the described embodiment of the overflow drain outlet cover system 20.

In reference to FIG. 5 and FIG. 6, hinge 44 preferably comprises two external tabs 62 and 64, each having an aperture 63 and 65, respectively. External tabs 62 and 64 are preferably welded to cover 40, as shown. Hinge 44 further comprises two internal tabs 66 and 68, each having an aperture 67 and 69, respectively. Internal tabs 66 and 68 are preferably welded to attachment band 42, as shown. Preferably, hinge 44 further comprises bolt 70, washer 72, washer 74, lock washer 76, nut 78 and sleeve 80. Preferably, as illustrated in FIG. 6, bolt 70 passes through washer 72, external tab 64, internal tab 69, sleeve 80, internal tab 67, external tab 63, washer 74 and lock washer 76. Preferably, nut 78 is threadably attached to bolt 70 and is tightened in well-known ways, thereby connecting the hinge 44.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A pipe cover system for a pipe end opening of a wall drain outlet pipe, comprising, in combination:

a) a cover structured and arranged to substantially cover the wall drain outlet pipe end opening;

b) an attacher structured and arranged to attach said cover to the pipe end opening; and c) a cover opening system structured and arranged to allow flowing water to open said cover sufficiently to allow flowing water to pass from the pipe end opening;

d) wherein said cover is further structured and arranged to hide said attacher and cover opening system.

2. The pipe cover system according to claim 1, further comprising a restrictor structured and arranged to assist in restricting unwanted matter from entering the pipe end opening.

3. The pipe cover system according to claim 1, wherein said cover opening system comprises at least one rotator structured and arranged to rotatedly open said cover sufficiently to allow flowing water to pass from the pipe end opening.

4. The pipe cover system according to claim 3, wherein said rotator comprises at least one hinge structured and arranged to hingedly connect said cover to said attacher.

5. The pipe cover system according to claim 1, wherein at least one surface of said cover is structured and arranged to be bondable to a coating.

6. The pipe cover system according to claim 5, wherein said at least one surface of said cover is structured and arranged to be bondable to a cementitious coating.

7. The pipe cover system according to claim 5, wherein said at least one surface of said cover is structured and arranged to be bondable to a paint coating.

8. The pipe cover system according to claim 4 wherein said cover and said at least one hinge are structured and arranged such that said at least one hinge supports said cover at a cover top portion and allows rotation of said cover outwardly in such manner that when flowing water gravitates from the pipe end opening to said cover, said cover swings open sufficiently to allow flowing water to pass from the pipe end opening.

9. The pipe cover system according to claim 8, wherein at least one surface of said cover is structured and arranged to be bondable to a coating.

10. The pipe cover system according to claim 9, wherein said attacher further comprises a clamp structured and arranged to substantially engage a circumference of the pipe end opening and be tightened around the pipe end opening.

11. The pipe cover system according to claim 1, wherein said attacher further comprises a clamp structured and arranged to substantially engage a circumference of the pipe end opening and be tightened around the pipe end opening.

12. The pipe cover system according to claim 4, wherein said attacher further comprises a clamp structured and arranged to substantially engage a circumference of the pipe end opening and be tightened around the pipe end opening.

13. The pipe cover system according to claim 3, wherein said attacher comprises said rotator.

14. The pipe cover system according to claim 1, further comprising:

a. a wall drain outlet pipe having a pipe end opening;

b. wherein said cover is attached to said pipe end opening by said attacher.

15. The pipe cover system according to claim 14 further comprising:

a) a building, having an exterior wall, substantially enclosing said wall drain outlet pipe;

b) wherein said pipe end opening is situated adjacent said exterior wall; and c) wherein at least one surface of said cover is structured and arranged to be bondable to a coating visually matching said exterior wall.

16. A pipe cover system for a pipe end opening of a wall drain outlet pipe, comprising, in combination:

a) a cover structured and arranged to cover the pipe end opening;

b) wherein a surface of said cover is structured and arranged to be bondable to a coating; and c) at least one hinge structured and arranged so that said at least one hinge, when attached with the pipe end opening, supports said cover at a cover top portion, is hidden behind said cover top portion, and allows rotation of said cover outwardly in such manner that when flowing water gravitates from the wall drain outlet pipe to said cover, said cover swings open sufficiently to allow flowing water to pass from the pipe end opening.

17. The pipe cover system according to claim 16, further comprising a circular band, with an adjustable tightener, said band being structured and arranged to be tightened around an external surface of the wall drain outlet pipe adjacent the pipe end opening.

18. The pipe cover system according to claim 17, wherein said hinge connects said cover with said circular band.

19. A pipe cover system, for a pipe end opening of a wall drain outlet pipe, comprising, in combination:

a) a cover structured and arranged to cover the pipe end opening, b) wherein a surface of said cover is structured and arranged to be bondable to a coating; and c) at least one hinge structured and arranged so that said at least one hinge, when attached with the pipe end opening, supports said cover at a cover top portion and allows rotation of said cover outwardly in such manner that when flowing water gravitates from the wall drain outlet pipe to said cover, said cover swings open sufficiently to allow flowing water to pass from the pipe end opening d) a circular band, with an adjustable tightener, said band being structured and arranged to be tightened around an external surface of the wall drain outlet pipe adjacent the pipe end opening, and wherein said hinge connects said cover with said circular band; and e) a restrictor attached to said circular band, said restrictor being structured and arranged to assist in restricting unwanted matter from entering the pipe end opening.

20. The pipe cover system according to claim 19 wherein:

a. said restrictor comprises at least one round bar; and b. wherein said cover has a diameter about two inches greater than a diameter of the pipe.

21. The pipe cover system according to claim 1 wherein said cover has a diameter between about 1 inches and about 4 inches greater than a diameter of the pipe.

22. The pipe cover system according to claim 1 wherein:

a) said cover consists of a substantially flat, substantially round disc;

b) wherein said cover is structured and arranged such that all that is visible when viewing the pipe cover system from the front is said substantially flat, substantially round disc.

* * * * *